US009482063B2

(12) United States Patent
Morelli et al.

(10) Patent No.: US 9,482,063 B2
(45) Date of Patent: Nov. 1, 2016

(54) PIPE HANDLING SYSTEM, APPARATUS AND METHOD

(76) Inventors: Vince Morelli, Red Deer County (CA); Darcy Ludwig, Red Deer (CA)

( * ) Notice: Subject to any disclaimer, the term of this patent is extended or adjusted under 35 U.S.C. 154(b) by 251 days.

(21) Appl. No.: 13/209,391

(22) Filed: Aug. 13, 2011

(65) Prior Publication Data

US 2012/0039688 A1 Feb. 16, 2012

Related U.S. Application Data

(60) Provisional application No. 61/373,798, filed on Aug. 13, 2010.

(30) Foreign Application Priority Data

Aug. 16, 2010 (CA) ..... 2713051

(51) Int. Cl.
*B65G 35/02* (2006.01)
*E21B 19/15* (2006.01)

(52) U.S. Cl.
CPC ..... *E21B 19/15* (2013.01)

(58) Field of Classification Search
CPC ..... E21B 19/14; E21B 19/15
USPC ..... 414/22.51–22.71, 910, 911; 198/625, 198/725; 219/647, 674; 211/70.4
See application file for complete search history.

(56) References Cited

U.S. PATENT DOCUMENTS 2,294,658 A * 9/1942 Hazeltine ..... 83/407
2,959,268 A * 11/1960 McConnell ..... 198/346.2
3,029,608 A * 4/1962 Perkins ..... 405/208
3,168,183 A * 2/1965 Copper ..... 198/457.02
3,217,137 A * 11/1965 Weitzner ..... 219/201
3,244,270 A * 4/1966 Wohlnick ..... 198/663
3,411,766 A * 11/1968 Lanigan ..... 5/619
3,630,392 A * 12/1971 Cintract et al. ..... 414/746.8
3,795,326 A * 3/1974 Neilon et al. ..... 414/22.58
3,945,497 A * 3/1976 Greenberg ..... 211/70.4
3,986,618 A * 10/1976 Woolslayer et al. ..... 414/745.9
4,109,910 A * 8/1978 Gleason ..... 473/479
4,439,091 A * 3/1984 Frias ..... 414/22.59
4,474,520 A * 10/1984 Buckner et al. ..... 414/22.61
4,547,110 A * 10/1985 Davidson ..... 414/22.55
4,684,314 A * 8/1987 Luth ..... 414/746.1
5,310,043 A * 5/1994 Alcorn ..... 198/625
5,364,223 A * 11/1994 Bissex ..... 414/526
5,760,751 A * 6/1998 Gipson ..... 343/880
6,054,692 A * 4/2000 Hitomi et al. ..... 219/540
6,156,121 A * 12/2000 Hasebe et al. ..... 118/500
6,948,629 B1 * 9/2005 McClay ..... 211/196
7,044,487 B2 * 5/2006 Byrne ..... 280/163
7,131,803 B2 * 11/2006 Guarisco et al. ..... 410/35
7,413,523 B2 * 8/2008 Lu ..... 473/481
7,473,065 B2 * 1/2009 Wells ..... 414/22.57
2008/0138174 A1 * 6/2008 Hawkins ..... 414/22.54
2008/0279688 A1 * 11/2008 Jensen et al. ..... 416/95
2009/0053013 A1 * 2/2009 Maltby ..... 414/22.61

* cited by examiner

*Primary Examiner* — Michael McCullough
*Assistant Examiner* — Lynn Schwenning
(74) *Attorney, Agent, or Firm* — Sander R. Gelsing

(57) ABSTRACT

In one aspect the invention provides a tubular handling system for use with a catwalk and a plurality of tubulars arranged in at least one tier and positioned substantially parallel adjacent the catwalk. The system comprises a tiering assembly positioned between said at least one tier and the catwalk and pipe rolling means adapted to move one or more of said tubular between said at least one tier and the tiering assembly in a sequential bi-directional manner. Preferably, the pipe rolling means comprises an auger, auger drive means and an auger positioning assembly.

16 Claims, 25 Drawing Sheets

PIPE HANDLING SYSTEM, APPARATUS AND METHOD

CROSS REFERENCE TO RELATED APPLICATION

This application is a regular application of U.S. Provisional Patent Application Ser. No. 61/373,798 filed Aug. 13, 2010 and entitled, "PIPE HANDLING SYSTEM, APPARATUS AND METHOD", the entirety of which is incorporated herein by reference.

FIELD OF THE INVENTION

The invention relates generally to pipe or tubular handling systems and in particular to a system, apparatus and method for providing tubulars to, and receiving tubulars from, a catwalk or similar unit.

BACKGROUND OF THE INVENTION

In the oil and gas well industry, drill strings of pipe, casings or other tubulars, are stored horizontally on pipe racks situated on the ground adjacent a drilling rig. Pipe launchers are then employed for presenting and receiving individual sections of pipe to and from drilling rig platforms. Such pipe launchers are often referred to as "catwalks" as they include platforms that run along their length for service personnel to walk upon.

To move the individual sections of pipe between a catwalk and a pipe rack, it is common practice to handle and roll such tubulars manually. This task is often completed by workers standing on the tubulars while the tubulars sit or rest on top of the pipe racks.

However, placing a worker on top of these tubulars has been deemed very dangerous in both the Canadian and United States oil and gas industry. Moreover, there are regulations in both countries that require that, when a worker is working over certain heights, he or she is harnessed by means of a fall arrest system to prevent the worker from falling, thereby reducing or eliminating the chance of injury or even death. However, even such fall arrest systems do not fully eliminate worker injuries or death.

What is needed is a system or apparatus to maneuver the tubulars in a manner where no worker will have to physically handle the tubulars.

BRIEF DESCRIPTION OF THE DRAWINGS

Embodiments of the invention will now be described, by way of example only, with reference to the accompanying drawings, wherein.

DETAILED DESCRIPTION OF THE PREFERRED EMBODIMENTS

Figure 1A:
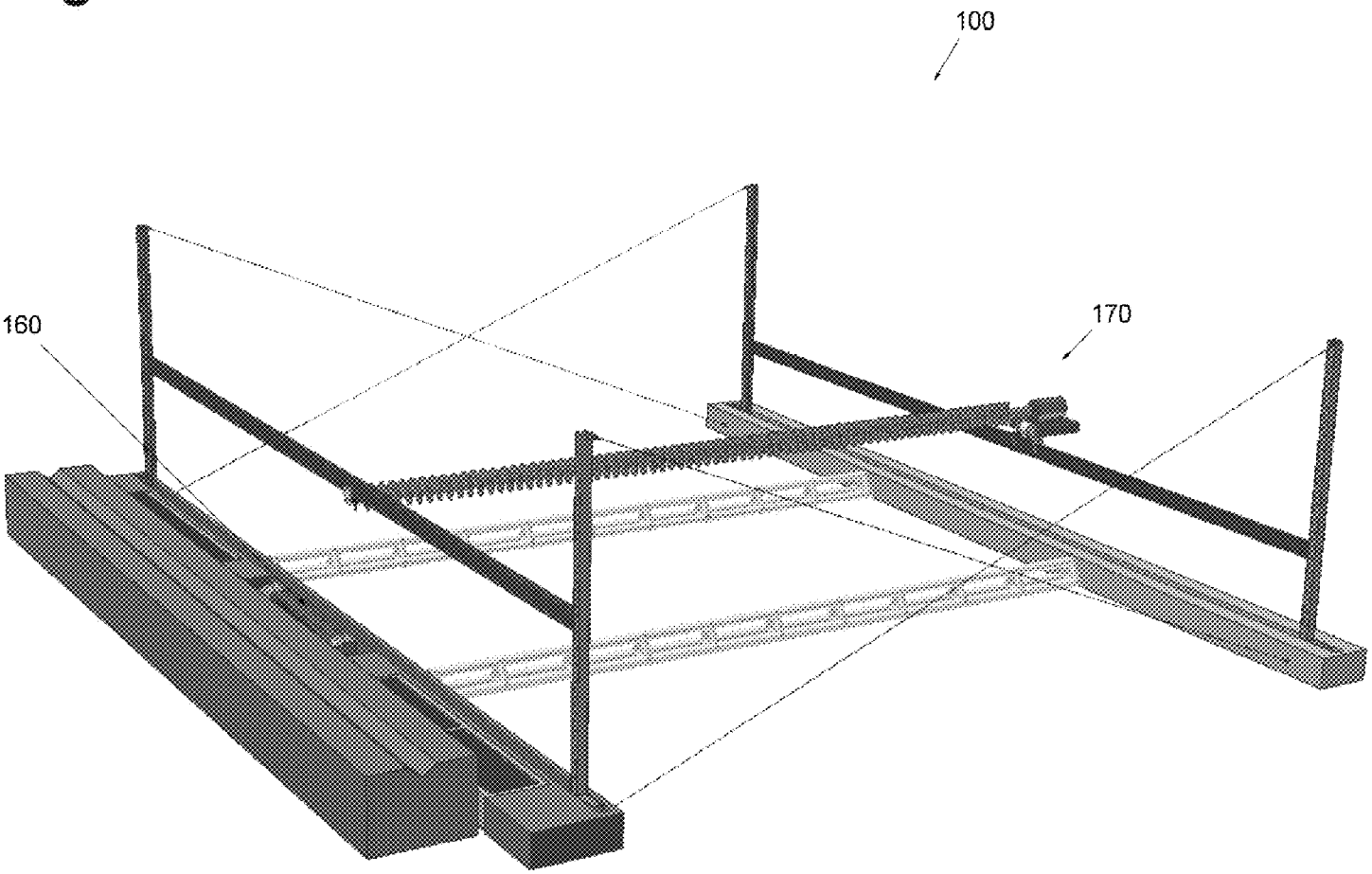
FIG. 1*a* is a front perspective view of one embodiment of the present invention.
Figure 1B:
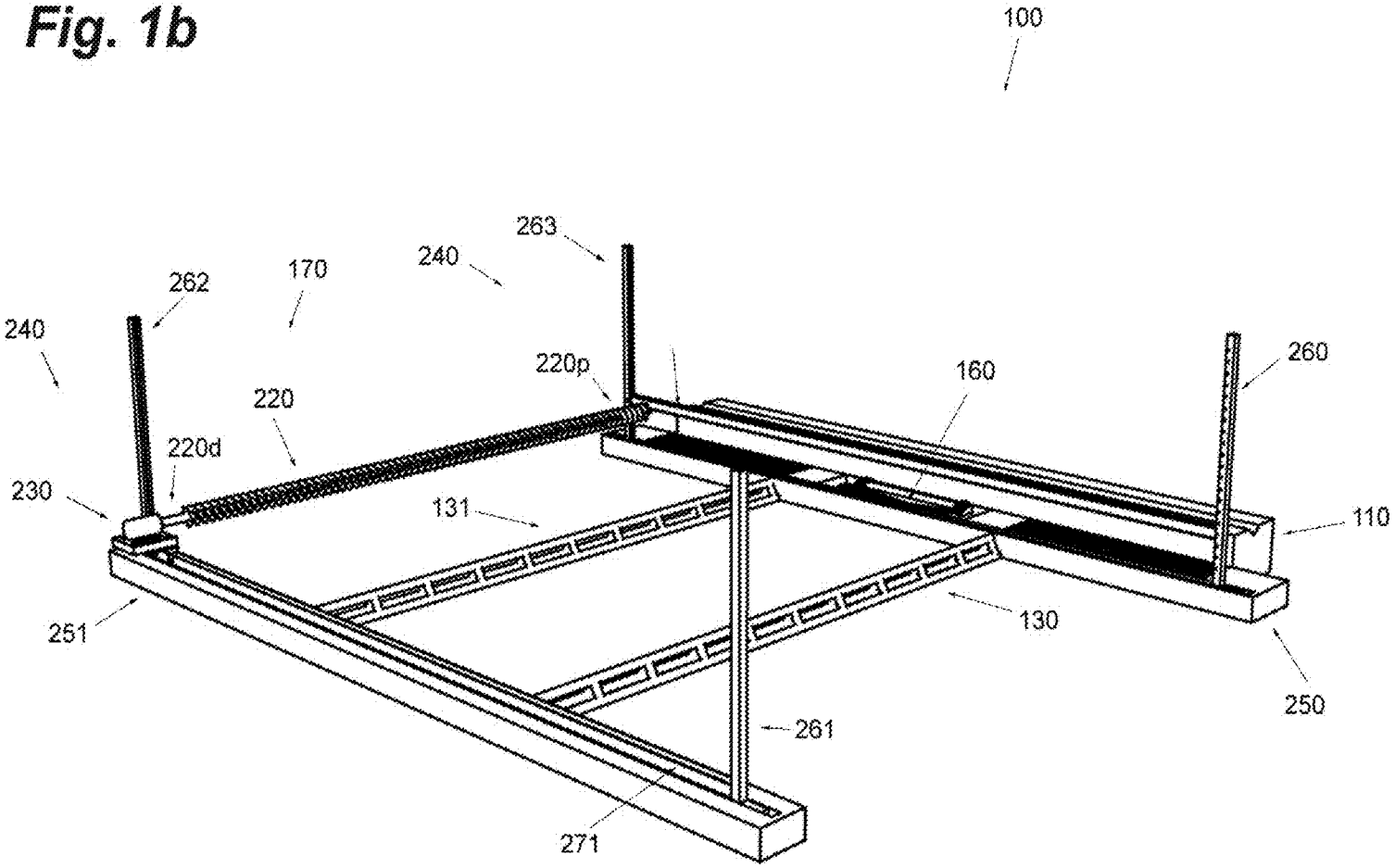
FIG. 1*b* is a rear perspective view of the embodiment of FIG. 1.
Figure 2:
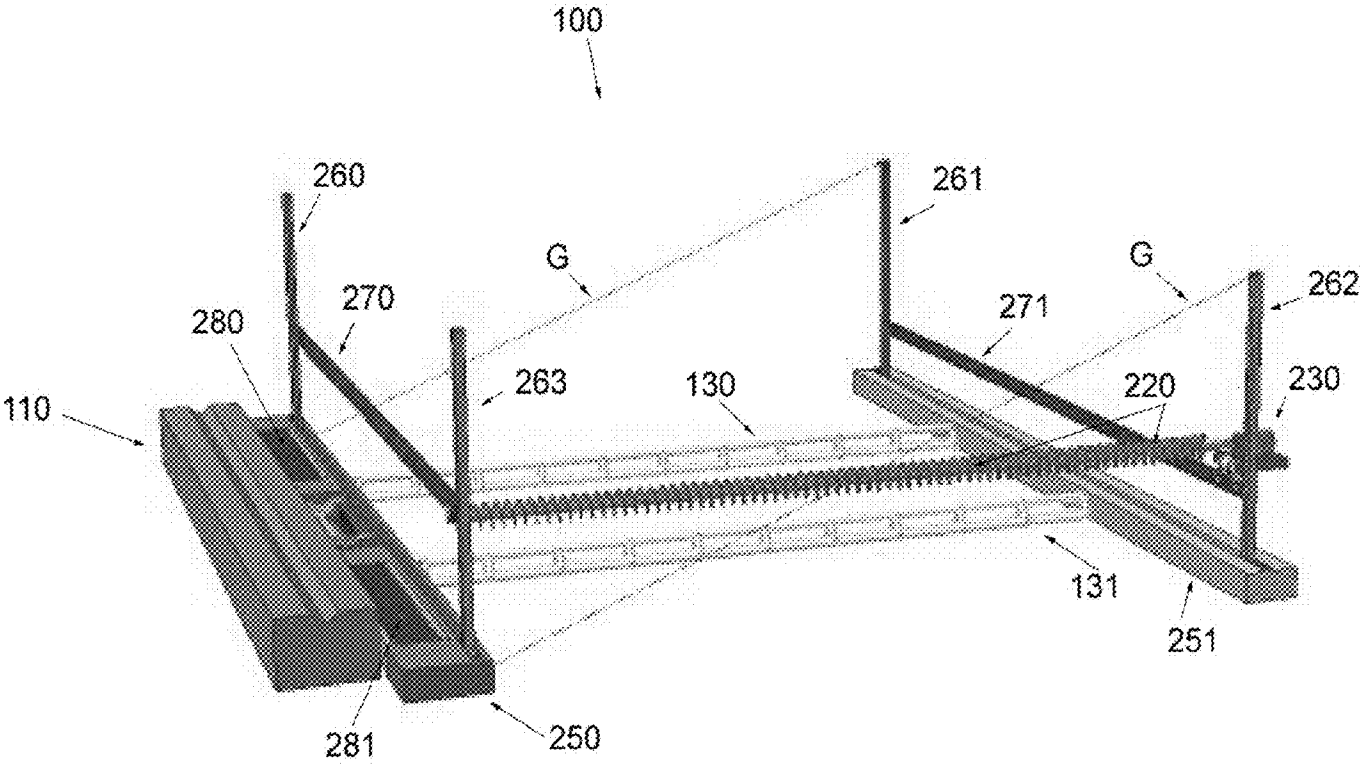
FIG. 2 is another front perspective view of the embodiment of FIG. 1.

The following description is of a preferred embodiment by way of example only and without limitation to the combination of features necessary for carrying the invention into effect. Reference is to be had to the Figures in which identical reference numbers identify similar components. The drawing figures are not necessarily to scale and certain features are shown in schematic form in the interest of clarity and conciseness.

Referring now in detail to the accompanying drawings, there is illustrated an exemplary embodiment of apparatus, method and system according to the present invention, the system generally referred to by the numeral 100.

Referring now to FIGS. 1*a*-37, there is illustrated one embodiment of a pipe handling system, denoted generally as 100.

During operation, the pipe handling system 100 is positioned adjacent a drilling rig's catwalk 110 and is, in part, positioned over top of tubulars 120. The tubulars 120 are stored horizontally on pipe racks 130, 131 situated on the ground adjacent the catwalk 110 (see, for example, FIGS. 23-25). In the present embodiment, the pipe racks 130, 131 are positioned in a generally perpendicular orientation to the catwalk 110 (see, for example, FIGS. 1*a*-2) and are conventional triangular steel framed structures.

The tubulars 120 are arranged in a plurality of tiers T, with each tier T comprising a plurality of individual tubulars 120 positioned substantially parallel to each other and to the catwalk 110 (see FIGS. 17-22 for the successive placement of tiers T on top of each other). The lowest, or bottom, tier T of tubulars 120 preferably rests or lies on the pipe racks 130, 131 (see FIGS. 17-18), with each successively higher tier T being separated from the previous tier T by virtue of resting or lying on divider members, stringers or strapping 150 which separate the overlying tubulars from those therebelow by a sufficient distance so as to allow the individual tubulars 120 in each tier T to roll along the strapping 150, including towards the catwalk 110, without interference from the underlying tubulars 120 or any of their collars.

In the present embodiment, the strapping 150 comprises a pair of elongate two-by-four pieces of lumber (i.e. a length of lumber that is 2 inches thick and 4 inches wide) arranged parallel to each other in spaced-apart relation and lying transverse across the tubulars 120 of the tier T below (see FIGS. 19-25). Preferably, no strapping is placed on top of the top tier T of tubulars 120. More preferably, the length of the strapping 150 is substantially equal to the width of each tier T of tubulars 120.

In another embodiment (not shown), the strapping 150 is 2 inch×2 inch angle iron. In yet another embodiment (not shown), the strapping 150 comprises a hollow elongate beam member that is 4 inches thick and 4 inches wide and capable of receiving a length of conventional electric heating coil there-within. Preferably said hollow elongate beam member is made of polyurethane. Advantageously, the electric heating coil can be turned on so as to impart sufficient heat energy to the elongate steel beam member so as to melt any snow or ice from said steel beam member that might otherwise interfere with the rolling of the tubulars 120 over top of said steel beam member strapping 150.

Figure 3:
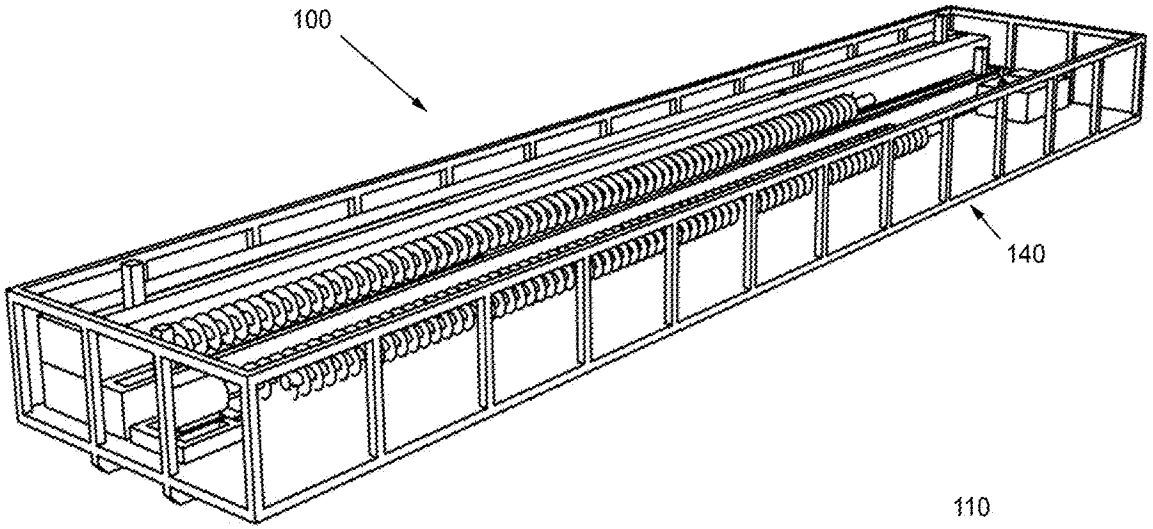
FIG. 3 is a front perspective view of the embodiment of FIG. 1, shown in a collapsed state within a transport tub or carrier.
Figure 4:
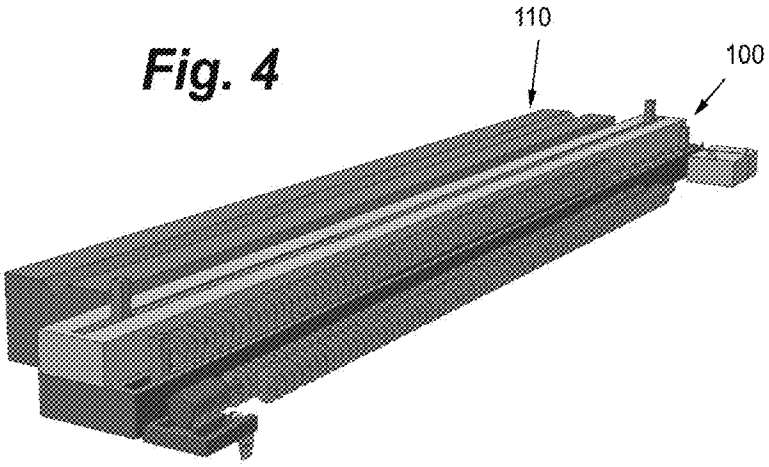
FIG. 4 is a front perspective view of the embodiment of FIG. 1, shown in a collapsed state, outside of the transport tub.
Figure 5:
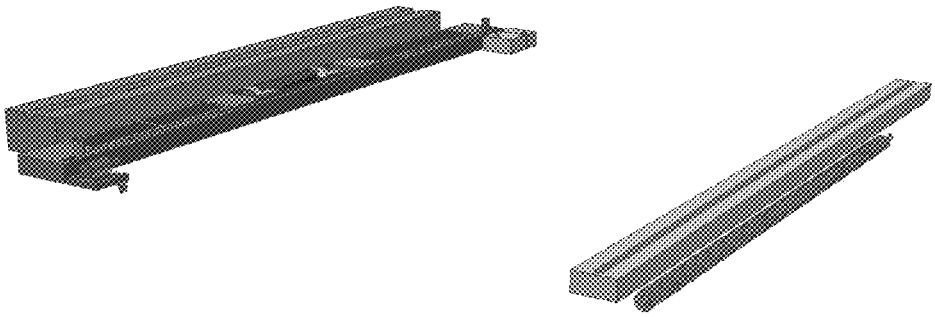
FIGS. 5-15 are various front perspective views of the embodiment of FIG. 1, illustrating, in a stepwise fashion, the transition of the system from a collapsed state to a fully assembled state.
Figure 6:
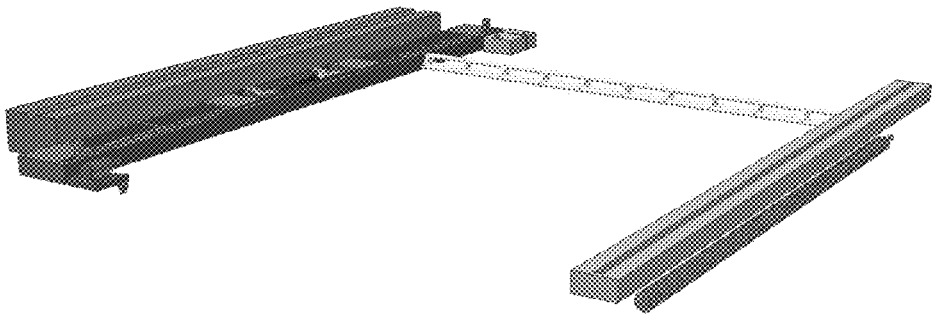
Figure 7:
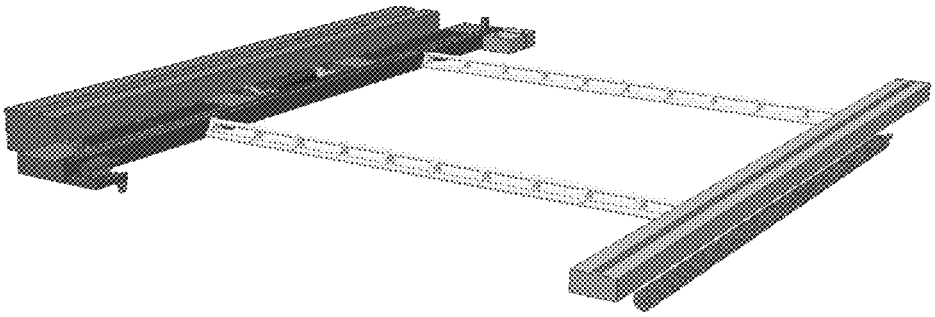
Figure 8:
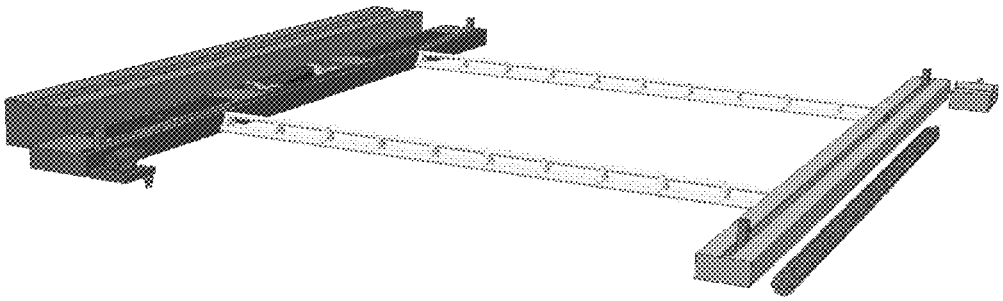
Figure 9:
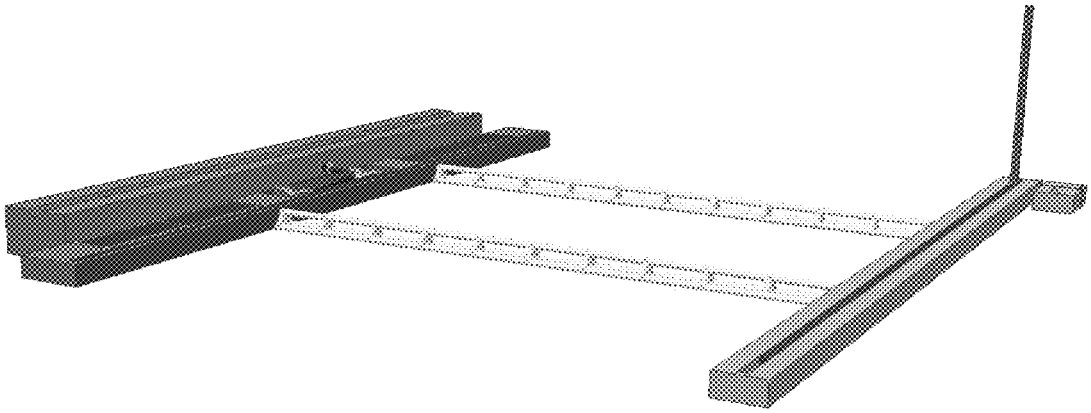
Figure 10:
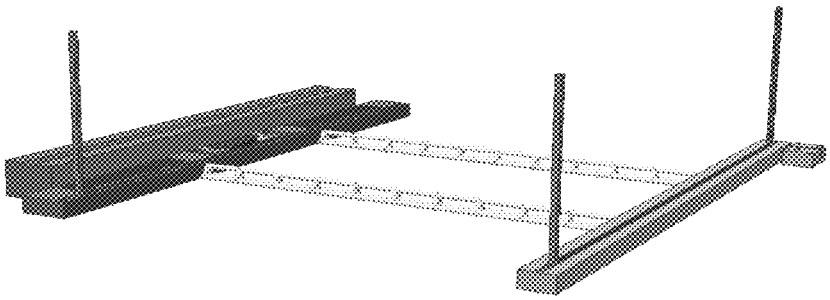
Figure 11:
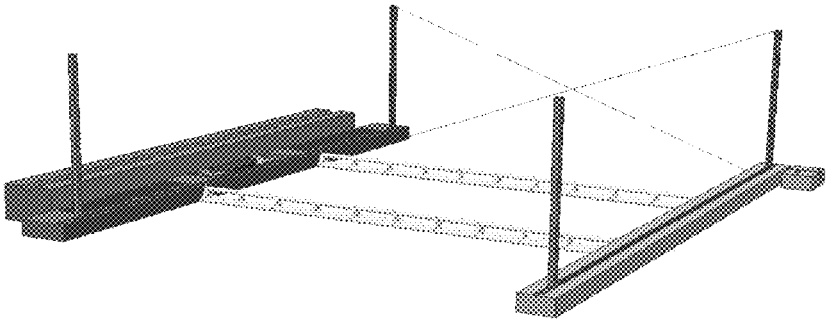
Figure 12:
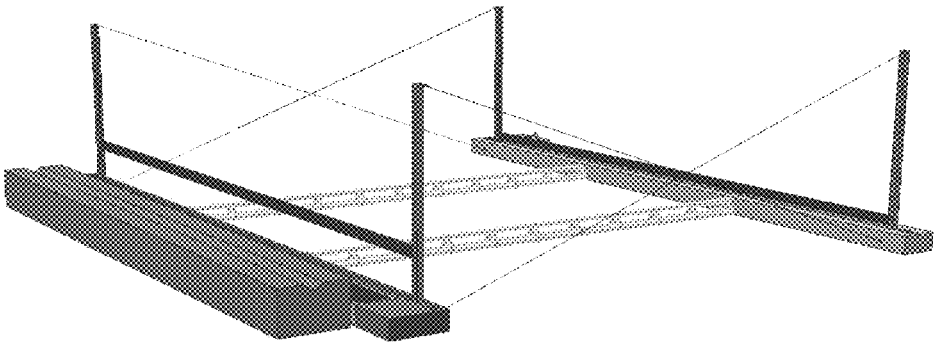
Figure 13:
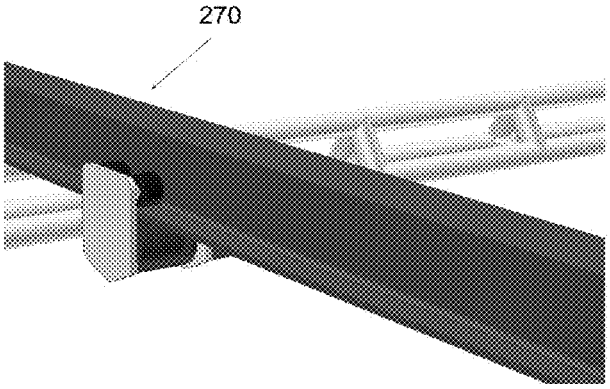
Figure 14:
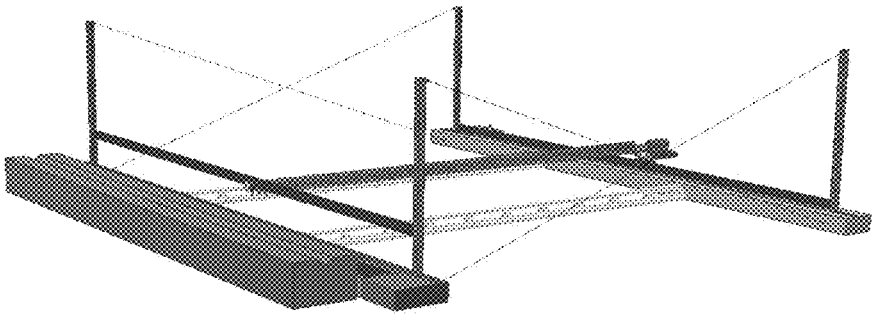
Figure 15:
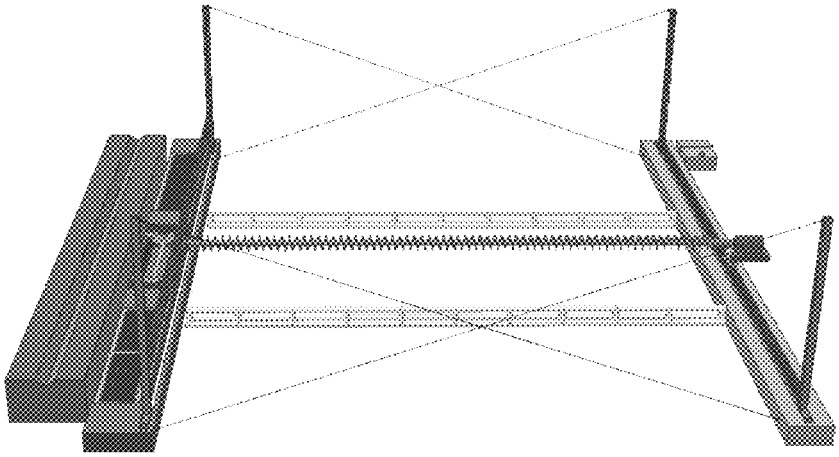
Figure 16:
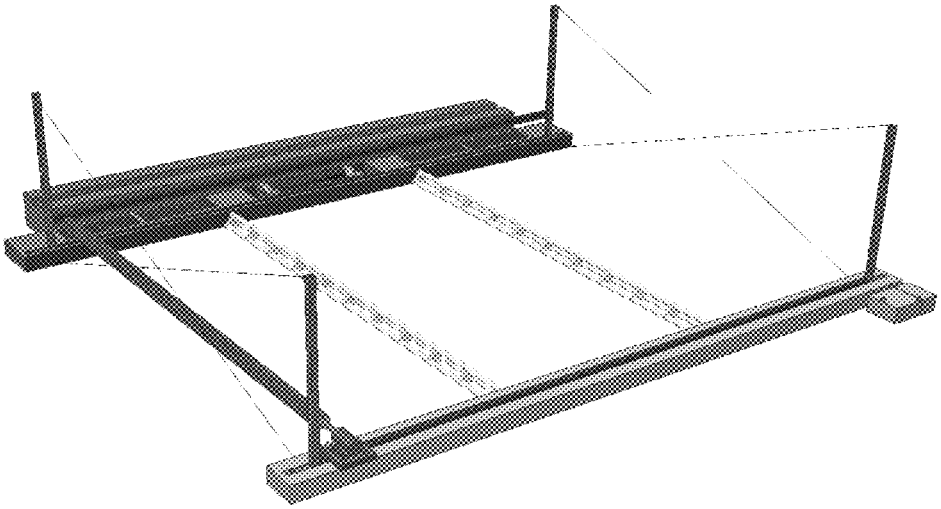
FIGS. 16-24 are various front perspective views of the embodiment of FIG. 1, illustrating, in a stepwise fashion, the placement of tubulars and strapping into tiers within the invention.
Figure 17:
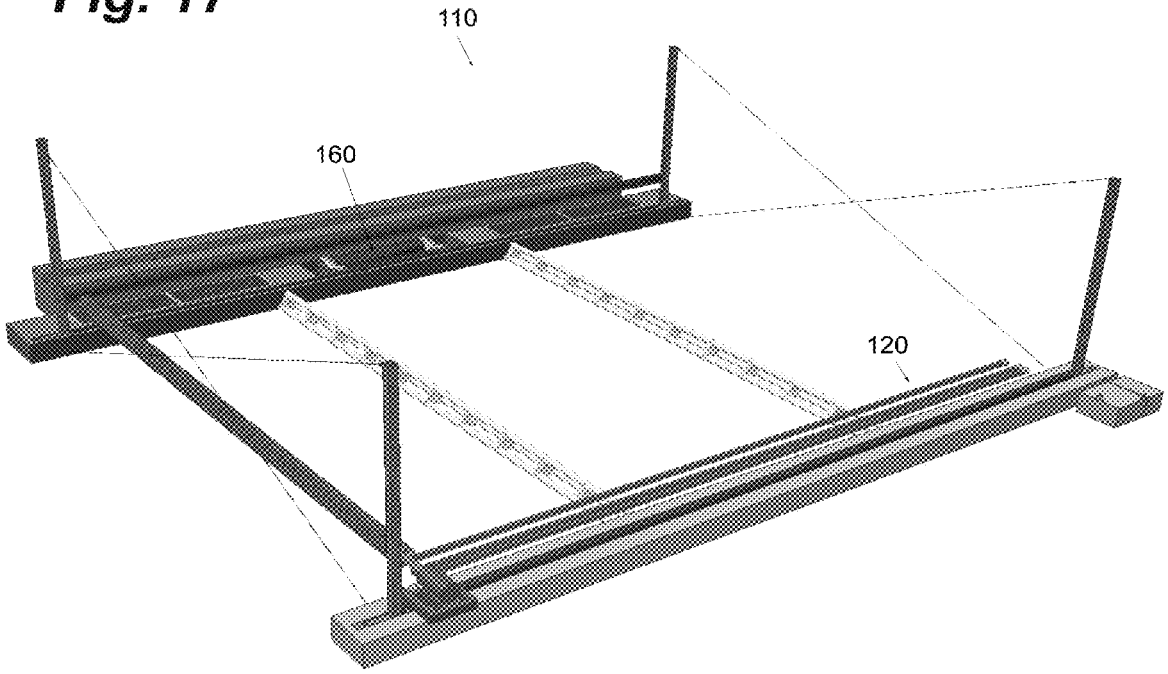
Figure 18:
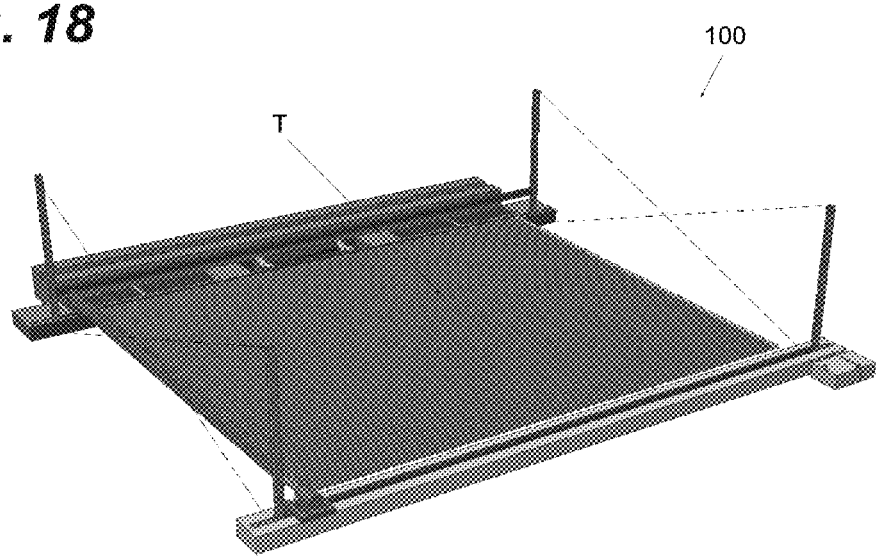
Figure 19:
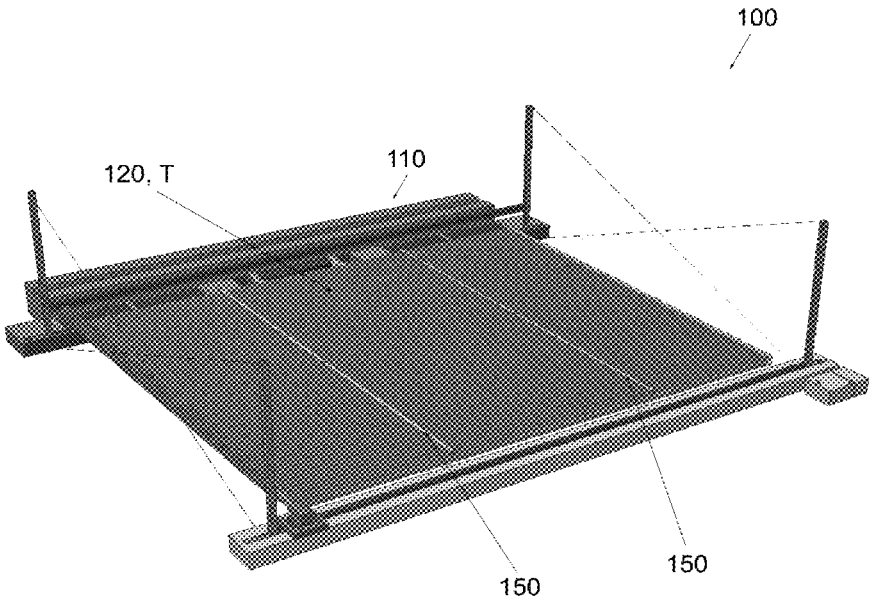
Figure 20:
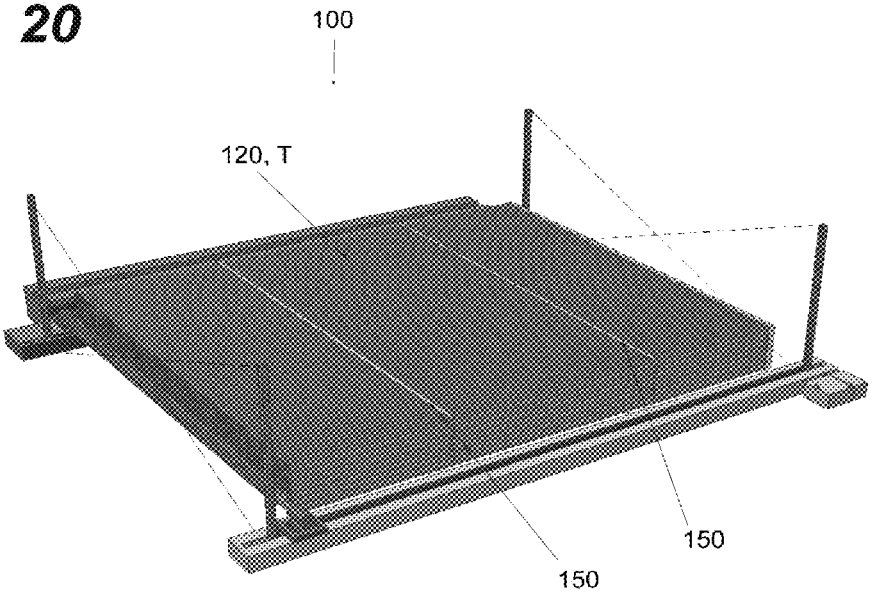
Figure 21:
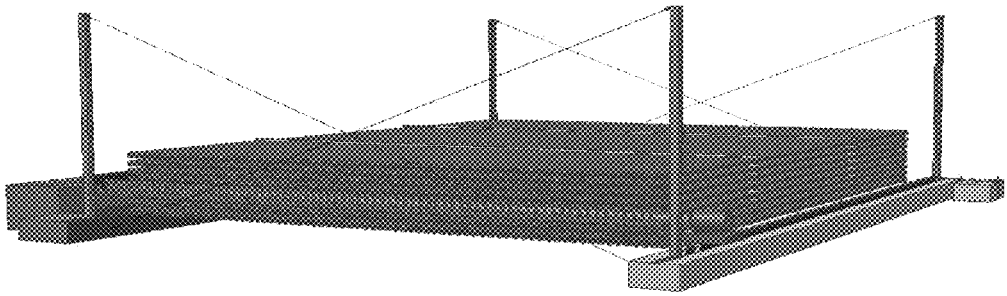
Figure 22:
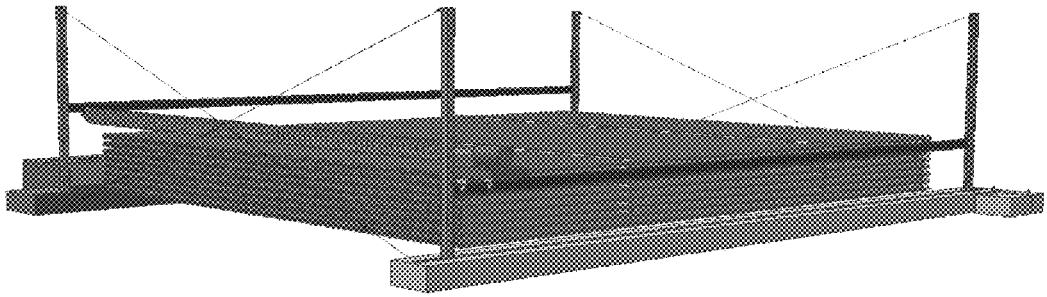
Figure 23:
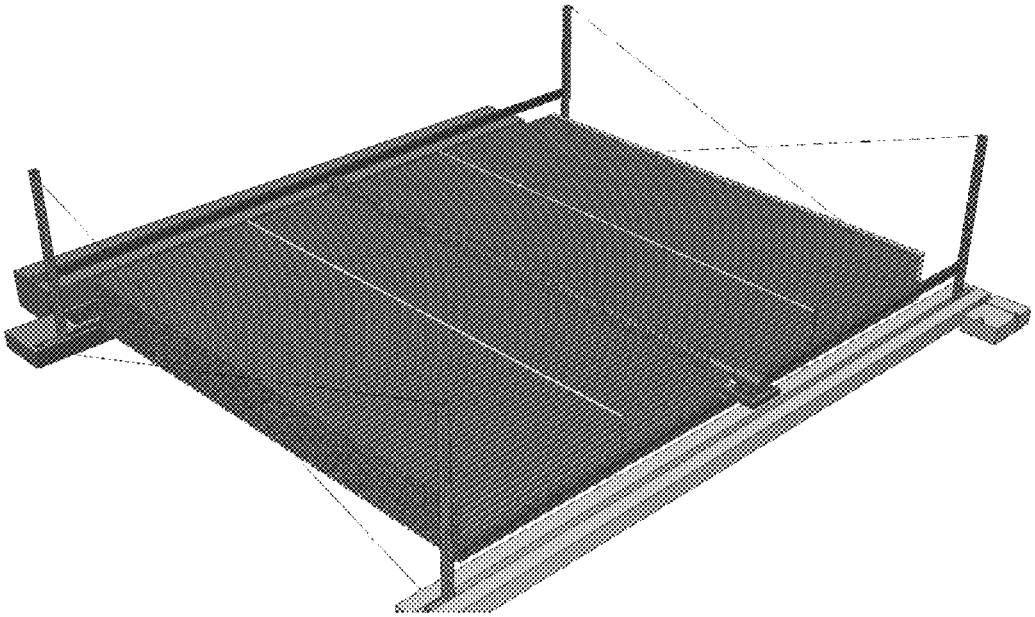
Figure 24:
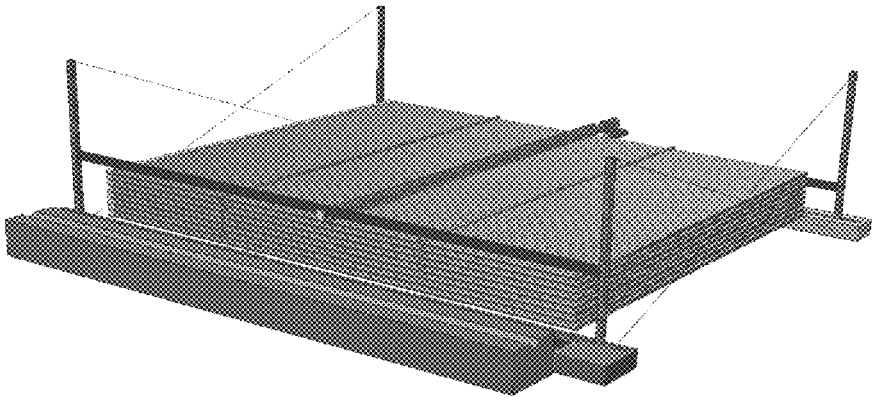
Figure 25:
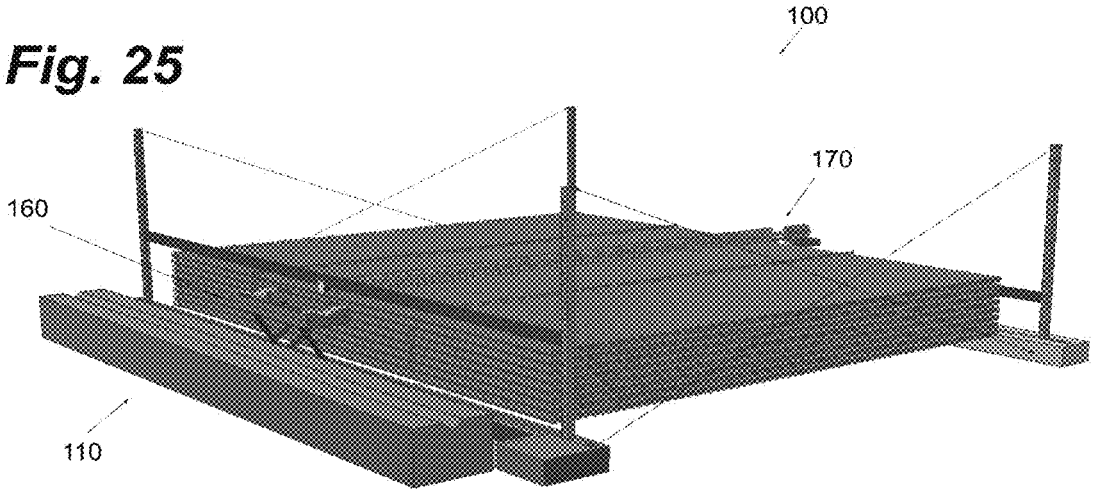
FIGS. 25-31*b* are various front perspective views of the embodiment of FIG. 1, illustrating, in a stepwise fashion, operation of the invention to deliver a tubular from a the stack of tiered tubulars to the tiering assembly (take-up of a tubular from the tiering assembly back to the stack of tiered tubulars will generally work in a reverse fashion)
Figure 26:
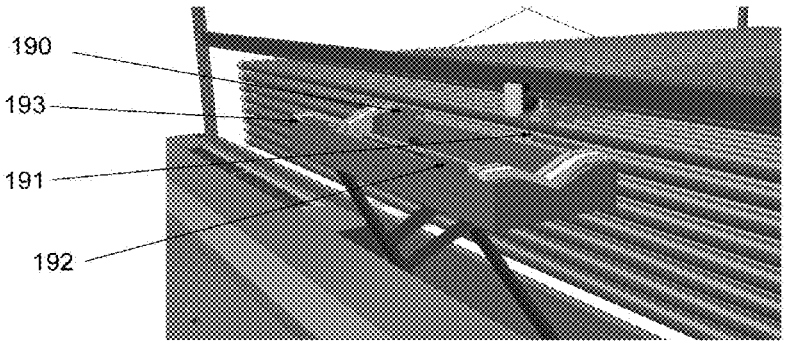

During transport, the pipe handling system 100 can be disassembled and arranged into a collapsed state for ease of transport within a transport tub or carrier 140 (see FIG. 3).

The pipe handling system 100 comprises a tiering assembly 160 that is positioned between the stacked tiers T of tubulars 120 and the catwalk 110 during operation (see FIGS. 1*a*, 26-37) and pipe rolling means 170 adapted to move one or more of the tubulars 120, on the top of the stacked tiers T, towards the tiering assembly 160 in a serial or sequential manner. The tiering assembly 160 is adapted to move a tubular 120 between the top of the stacked tiers T and the catwalk 110 in a bi-directional manner (see FIGS. 25-37).

In the embodiment of FIGS. 1*a*-37, the tiering assembly 160 comprises tubular receiving assembly 180 having a trough 181 suitable for receiving a tubular 120 therein (see FIG. 26), two pairs of bridging members 190, 191, 192, 193 pivotally coupled to the top side edges of the tubular receiving assembly 180 and adapted to pivot about a point in the horizontal plane (as more clearly shown in FIG. 27), two pairs of ejectors or kickers 200, 201, 202, 204 pivotally coupled to the side edges of the tubular receiving assembly 180 and adapted to pivot about a point in the vertical plane (as more clearly shown in FIG. 34) and tiering assembly height adjustment means 210 to raise and lower the tubular receiving assembly 180 as may be desired and to align said tubular receiving assembly 180 with the top tier T.

In the present embodiment, the tiering assembly height adjustment means 210 is a scissor lift. Preferably, the tiering assembly height adjustment means 210 is hydraulically actuated in a conventional manner. More preferably, the bridging members 190, 191, 192, 193 and kickers 200, 201, 202, 204 are also hydraulically actuated by means of rotary hydraulic actuators. Pentalift equipment corporation of Guelph, Ontario, Canada, is one company that manufactures suitable scissor lifts.

During operations tubular receiving assembly 180 carries a tubular 120 between the top of the stacked tiers T and the catwalk 110 in a bi-directional manner (see FIGS. 25-37). Bridging members 190, 191, 192, 193 are normally in a retracted position wherein they are positioned parallel to the sides of the tubular receiving assembly 180 and away from the sides of the stacked tiers T and catwalk 110 (for example, see FIG. 26) so as not to interfere with the vertical movement of the tubular receiving assembly 180 alongside the stacked tiers T and catwalk 110. Kickers 200, 201, 202, 204 are normally in a recessed position wherein they are positioned substantially within the trough 181 so as not to interfere with carriage of a tubular 120 within said trough 181 (see FIG. 26).

Figure 27:
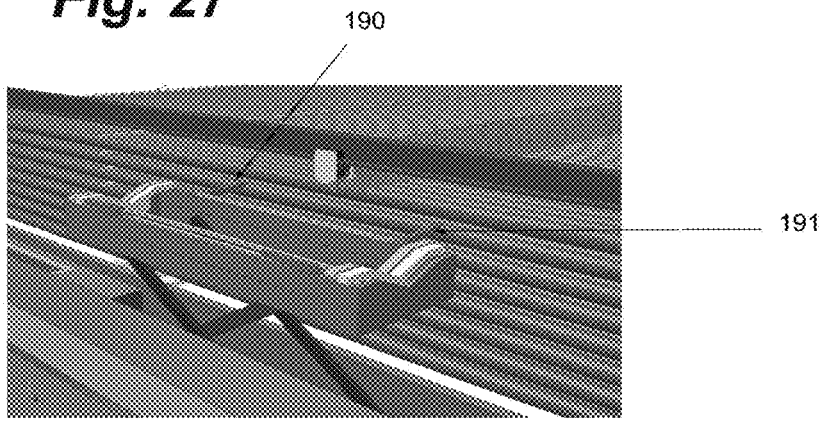
Figure 28:
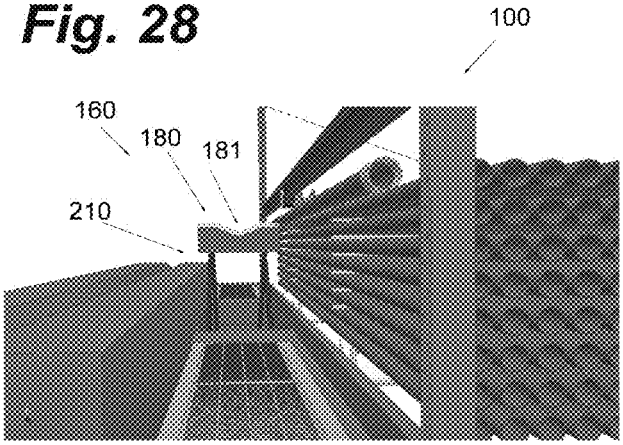
Figure 29:
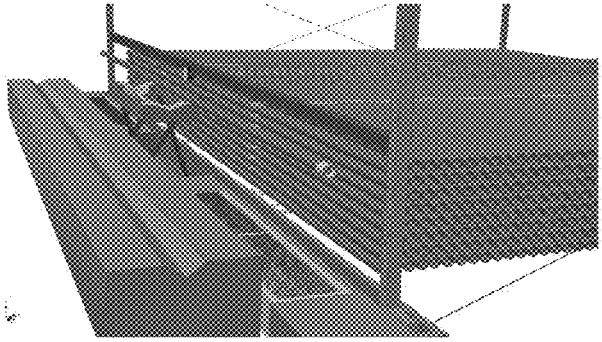
Figure 30:
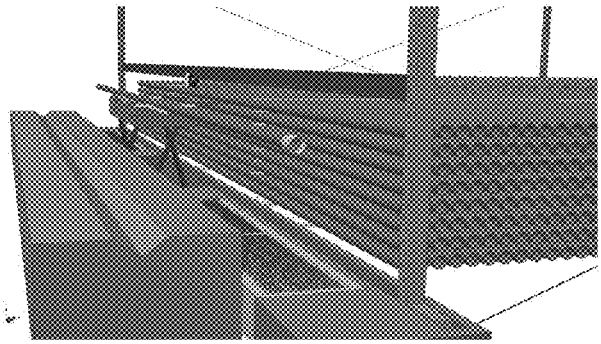
Figure 31A:
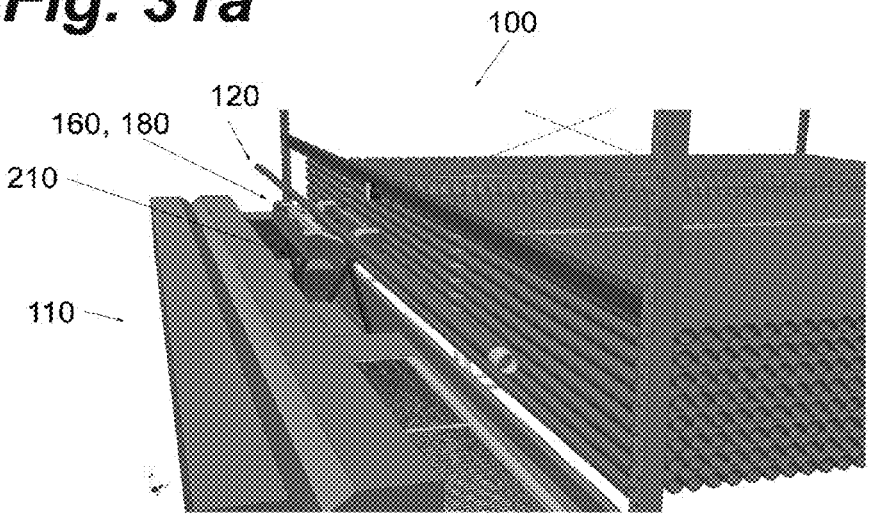
Figure 31B:
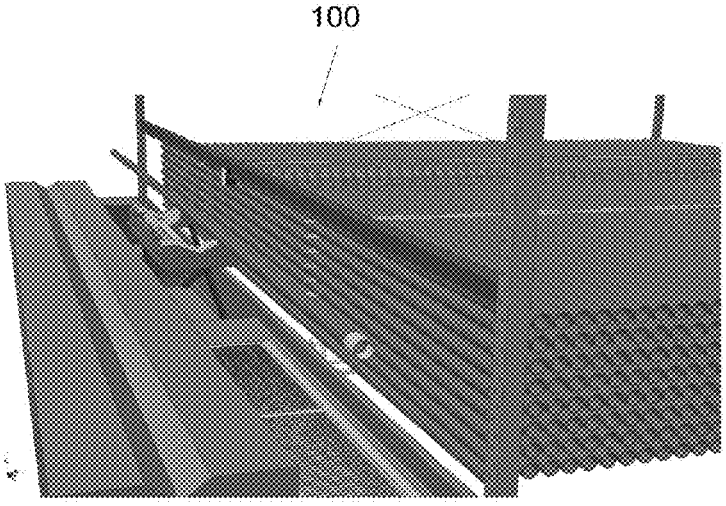
Figure 32:
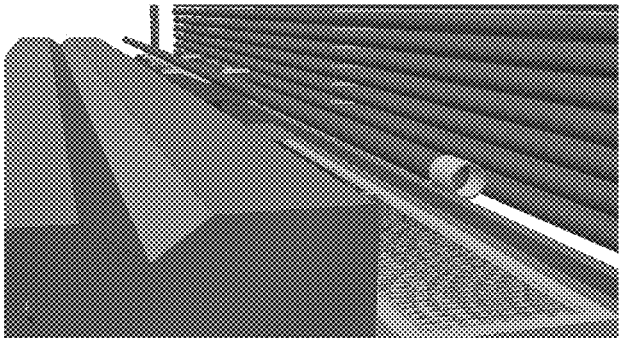
FIGS. 32-37 are various front perspective views of the embodiment of FIG. 1, illustrating, in a stepwise fashion, operation of the invention to deliver a tubular from the tiering assembly to a catwalk.
Figure 33:
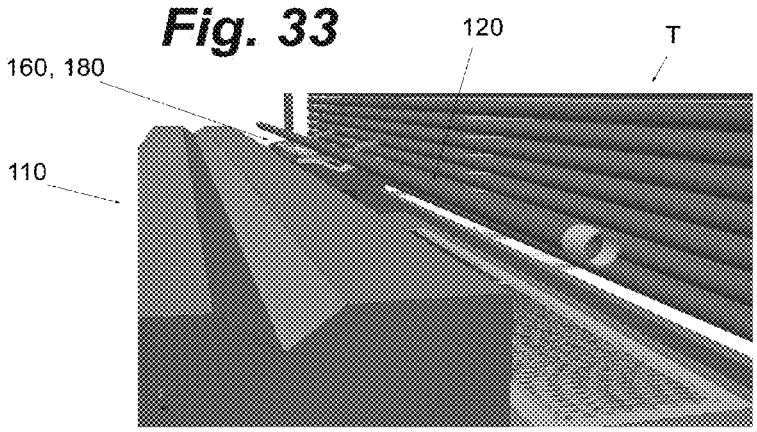
Figure 34:
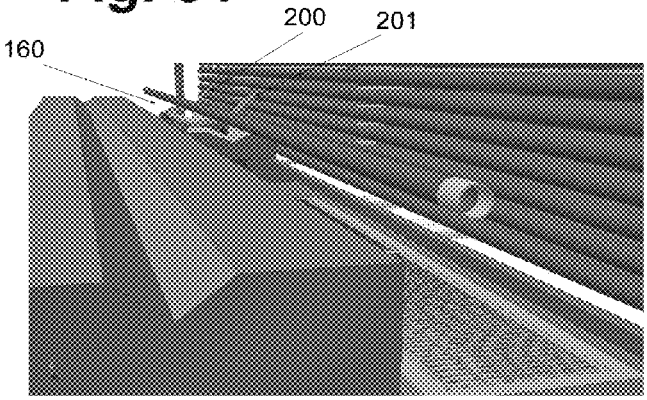
Figure 35:
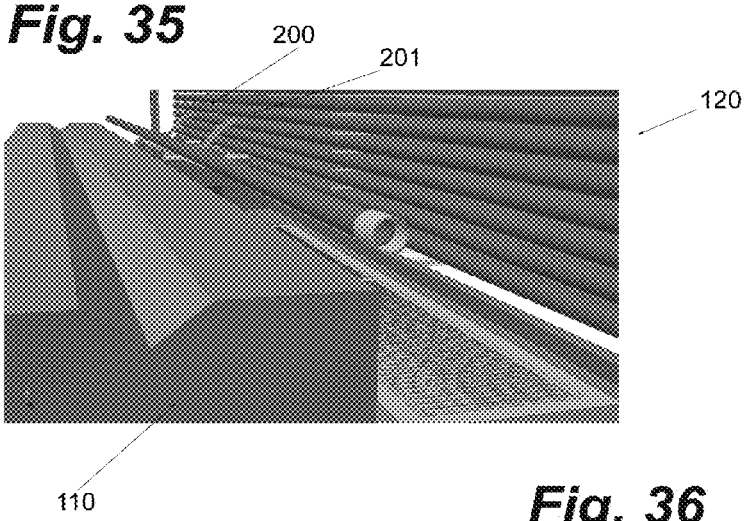
Figure 36:
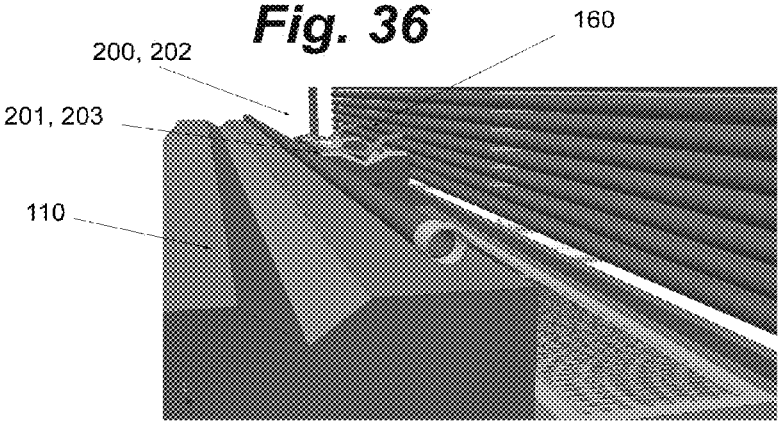
Figure 37:
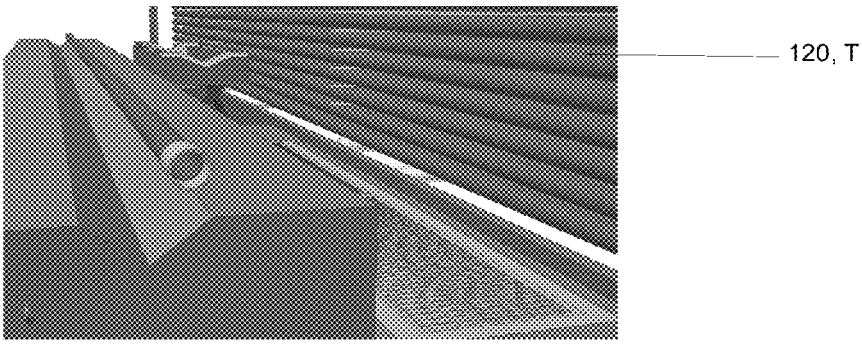
Figure 38:
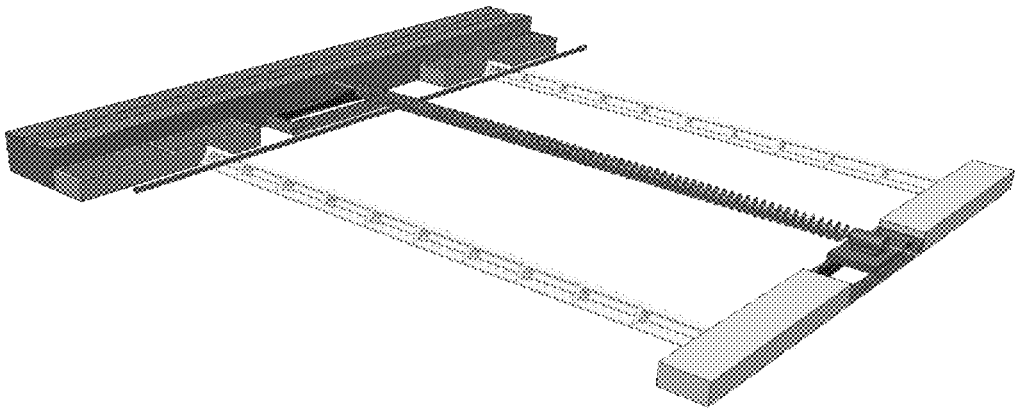
FIGS. 38-46 are various front perspective views of another embodiment of the invention wherein the auger position assembly comprises a scissor lift.
Figure 39:
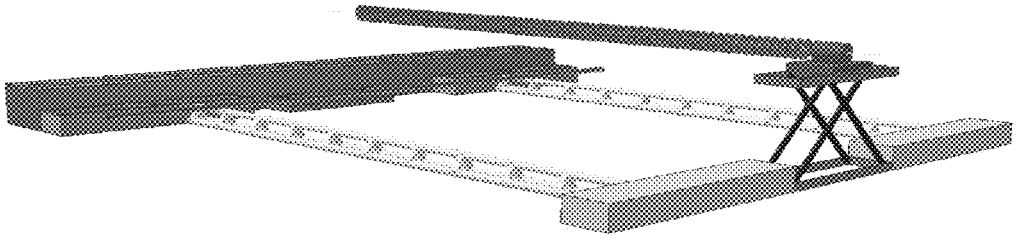
Figure 40:
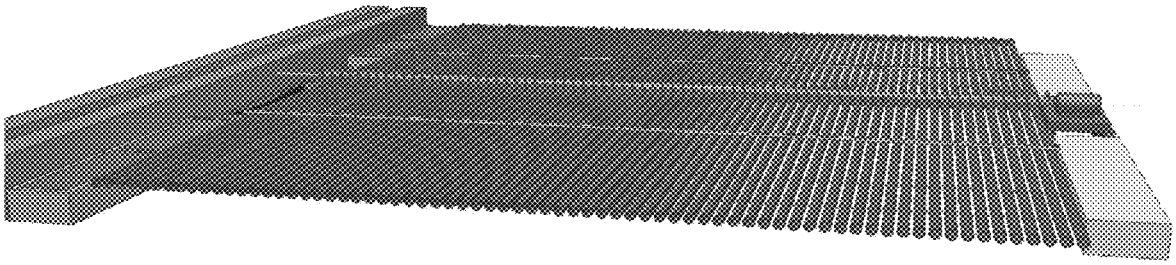
Figure 41:
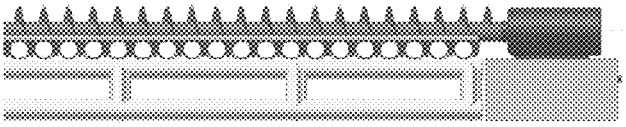
Figure 42:
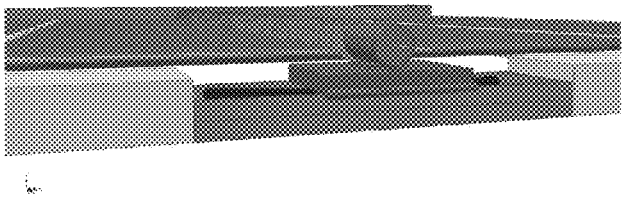
Figure 43:
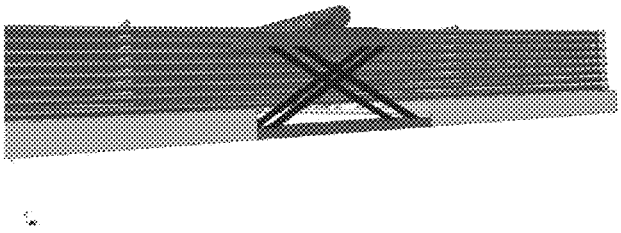
Figure 44:
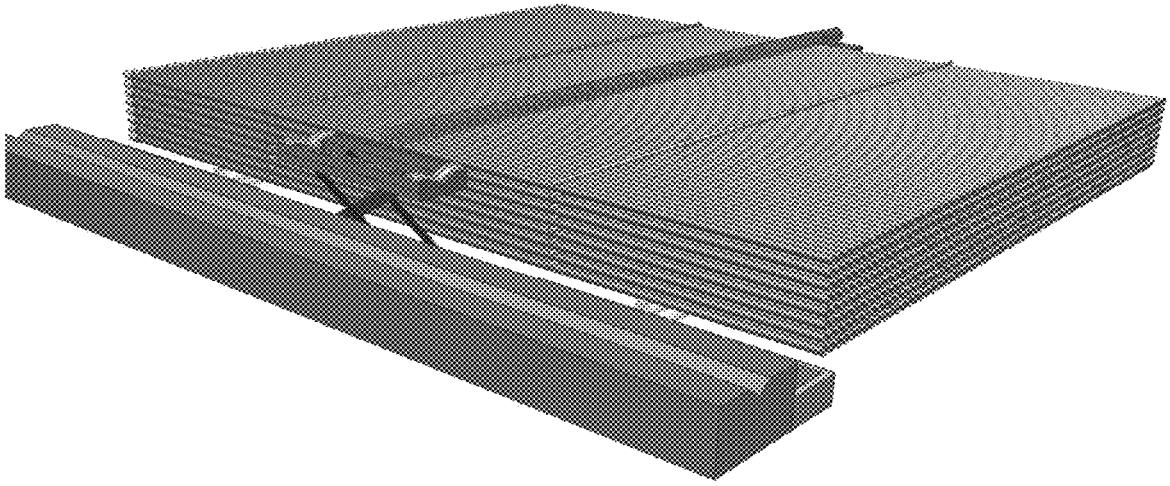
Figure 45:
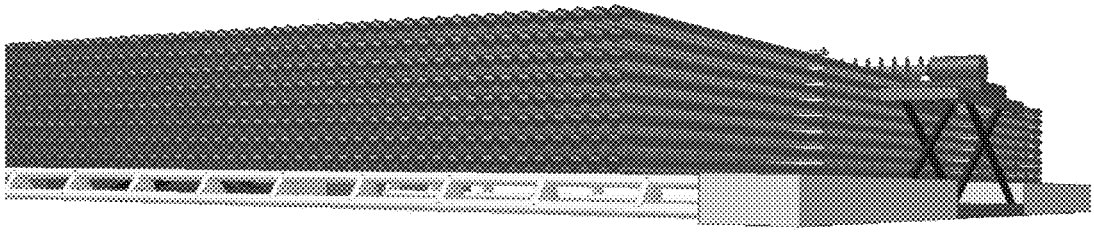
Figure 46:
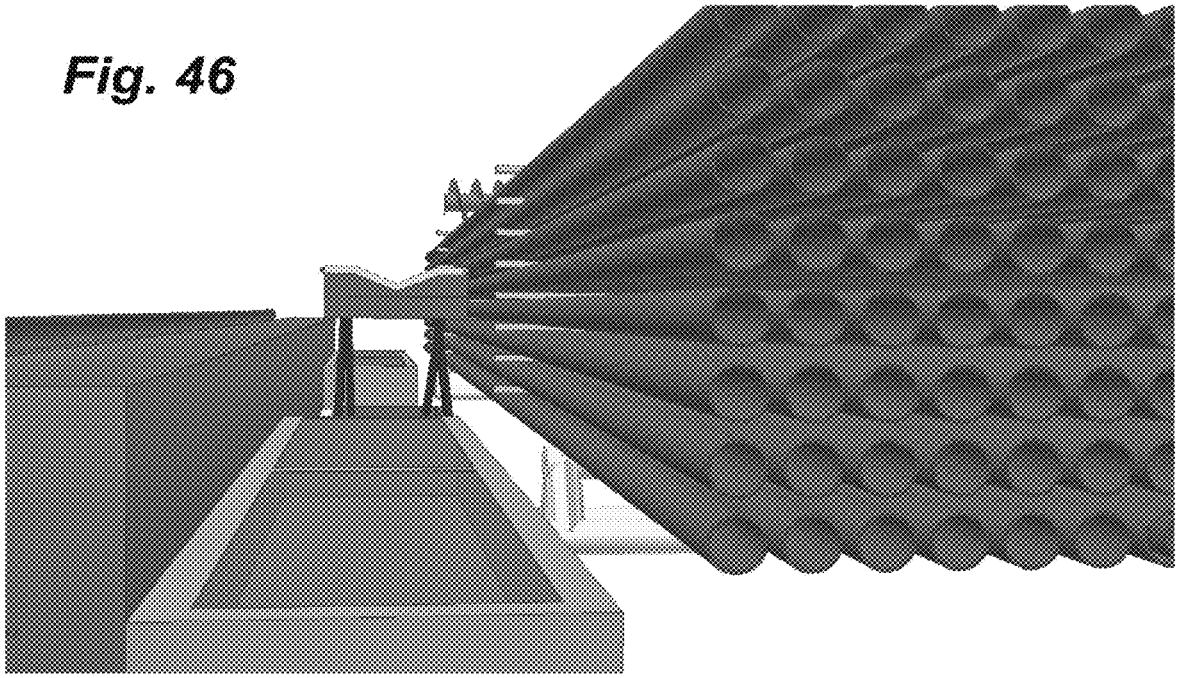
Figure 47:
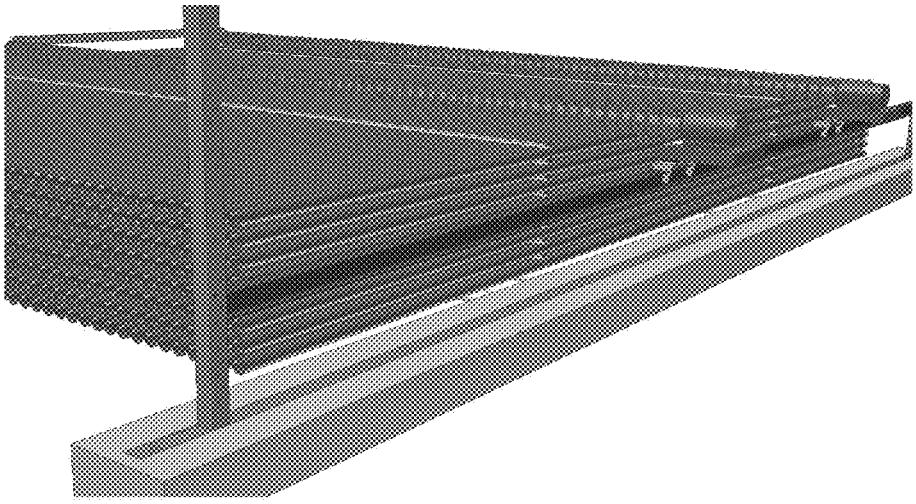
FIGS. 47-50 are various front perspective views of yet another embodiment of the invention wherein the pipe rolling means comprises a pair of augers instead of the single auger of the first and second embodiments.
Figure 48:
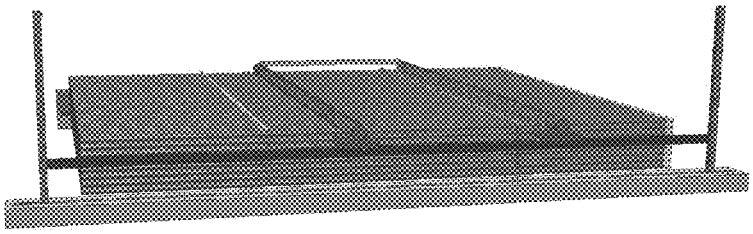
Figure 49:
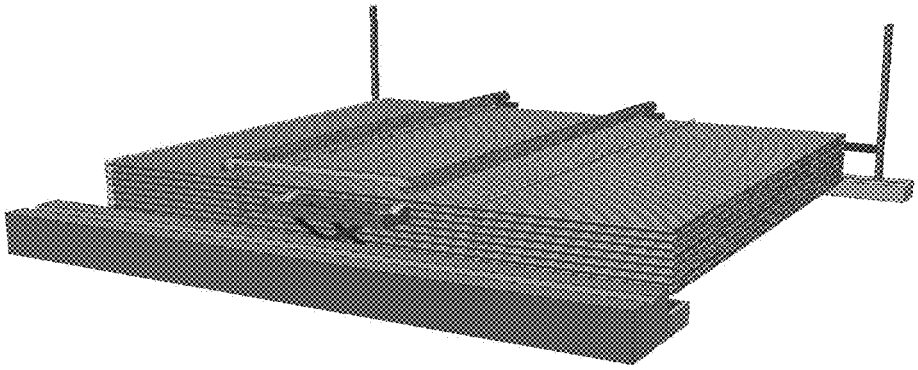
Figure 50:
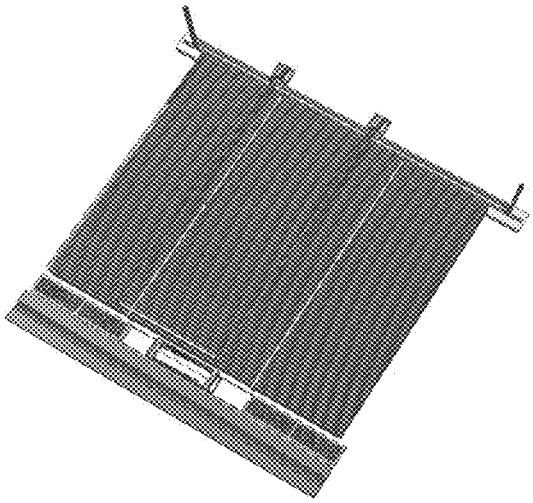

At the appropriate times (e.g. when loading a tubular 120 from the stacked tiers T onto the tubular receiving assembly 180), one or more of the bridging members 190, 191, 192, 193 are actuated to pivot to a position substantially perpendicular to the sides of the tubular receiving assembly 180 to bridge any gap between the tiering assembly 160 and the stacked tiers T or between the tiering assembly 160 and the catwalk 110, and to thereby facilitate rolling of a tubular 120 onto, or off of, the tubular receiving assembly 180 (e.g. see FIG. 27). Additionally, at the appropriate times, one or more of the kickers 200, 201, 202, 204 are actuated to pivot to an ejection position (e.g. see FIG. 34) to eject or push out tubular 120 from the trough 181 and either into the catwalk 110 (see FIGS. 35-37) or back onto the stacked tiers T.

In the embodiment of FIGS. 1*a*-37, the pipe rolling means 170 comprises a screw conveyor or auger 220 having a proximal end 220*p* and a distal end 220*d*, auger drive means 230 and auger positioning assembly 240. During operations, the auger 220 is placed on top of the top tier T of tubulars 120, preferably so that each one of the tubulars 120 of the top tier T is positioned within a pitch of the auger's flighting (see FIG. 23-25). The pitch and outside flight diameter of the auger 220 will depend on the outside diameter of the tubulars 120 that is being handled.

Preferably, the auger 220 is configured so that, during operation, the contact or push point by the auger 22 with the tubulars 120 is at least one-third ($1/3^{rd}$) down from the outside diameter of the tubulars 120, so as to ensure that when the auger 220 is turned (by the auger drive means 230) horizontal forces are imparted to the tubulars 120. More preferably, the auger 220 is configured so that there is limited clearance between the auger's flighting and the tubulars 120 when the auger is placed on top of the top tier T, since excess clearance will increase the tendency that the row of tubulars 120 on the top tier T will veer of to one side rather than roll towards or away from the tiering assembly 160.

Preferably the auger drive means 230 is a low speed hydraulic motor with sufficient torque to move a tier T of tubulars 120. During operations, the auger drive means 230 will be actuated to rotate the auger 220, clockwise or counter-clockwise as required, to move the tubulars 120 as desired. Typically the auger drive means 230 will rotate the auger 220 so as to dispense, or take-up, one tubular at a time. Advantageously, the remaining tubulars on the top tier T will be contained by the auger 220.

In this embodiment, the auger positioning assembly 240 comprises a pair of base members 250, 251, four support posts 260, 261, 262, 263 and two spreader members 270, 271 which, during operation, are arranged in the general configuration shown in FIG. 1*a* with one of said support posts 260, 261, 262, 263 positioned generally upright at the ends of the base members 250, 251 in a paired configuration, and the spreader members 270, 271 attached between said paired support posts.

The auger 220 and auger drive means 230 are supported by the spreader members 270, 271 above the stacked tiers T as generally shown in FIG. 1*a* and with proximal end 220*p* adjacent the catwalk 110 and the distal end 220*d* away from the catwalk 110. Preferably, the auger drive means 230 is attached to the auger at the distal end 220*d*. The spreader members 270, 271 can be adjusted and securely positioned vertically along the support posts 260, 261, 262, 263 in a conventional manner so as to place the auger 220 at the desired height above the stacked tiers T. Preferably the base members 250, 251 further comprise fluid containers 280, 281 to collect liquid fluids (such as drilling mud or cleaning fluids used to clean the treads of the tubulars) that may drain out from the ends of the tubulars.

Preferably, auger positioning assembly 240 further comprises guy wires G to connect the top of one of support posts 260, 261, 262, 263 to the bottom of an opposing base member 250, 251, as more clearly shown in FIG. 1*a*. More preferably, during operation, the auger positioning assembly 240 is attached, or bolted, to the tiering unit so as to form a more stabilized unit, thereby decreasing the chance that one component of the invention 100 may slip or change position accidentally during operation. Even more preferably, during operation, the pipe racks 130 are attached or bolted to the base members 250, 251, so as to form a more stabilized unit.

Unless otherwise specified, it is preferred that the components of the invention be made of steel or other suitable high-strength materials capable of taking stresses and strains encumbent upon such a pipe handling system 100 during its intended use during pipe handling and moving operations.

Those of ordinary skill in the art will appreciate that various modifications to the invention as described herein will be possible without falling outside the scope of the invention.

The embodiments of the invention in which an exclusive property or privilege is being claimed are defined as follows:

1. A tubular handling system for use with a catwalk and a plurality of tubulars arranged in at least one tier and positioned substantially parallel adjacent the catwalk, the system comprising:

a tiering assembly positioned between said at least one tier and the catwalk and having a trough suitable for receiving a tubular from said plurality of tubulars therein; and pipe rolling means adapted to move one or more of said tubulars between said at least one tier and the tiering assembly in a sequential bi-directional manner, said pipe rolling means comprising:

an auger;

auger drive means; and an auger positioning assembly;

wherein, during tubular moving operations, the auger positioning assembly places the auger substantially horizontal on top of the tubulars being moved;

wherein the pipe rolling means is suitable to be positioned over top of said plurality of tubulars;

wherein the catwalk is suitable for service personnel to walk upon; and wherein the tiering assembly's trough may be raised or lowered to substantially align with the top of said at least one tier.

2. The tubular handling system of claim 1, wherein the plurality of tubulars are arranged in a plurality of tiers and further comprising strapping placed between each tier of tubulars.

3. The tubular handling system of claim 2, wherein the plurality of tiers rests on one or more pipe racks.

4. The tubular handling system of claim 1, wherein the tiering assembly further comprises:

a tubular receiving assembly for supporting said trough;

at least one bridging member, pivotally coupled to the tubular receiving assembly so as to pivot about a point in the horizontal plane and capable of selectably bridging the gap between the tiering assembly and the at least one tier of tubular;

at least one kicker capable of ejecting a tubular from the trough; and tiering assembly height adjustment means to raise and lower the tubular receiving assembly to align with the top of said at least one tier.

5. The tubular handling system of claim 4, wherein the tiering assembly height adjustment means is a scissor lift.

6. The tubular handling system of claim 1, wherein the auger is configured so that, during operations, the push point of the auger with the plurality of tubulars is at least one-third down from the outside diameter of said plurality of tubulars.

7. The tubular handling system of claim 1, wherein the auger positioning assembly comprises:

a pair of base members; positioned substantially parallel to the catwalk, with one of each of the pair of base members placed at either end of the said at least one tier of tubulars;

four support posts positioned generally upright at each end of said pair of base members, in a paired configuration;

two spreader members positioned generally between each paired configuration of support posts.

8. The tubular handling system of claim 1, wherein the auger and auger drive means are supported by the spreader members above said at least one tier.

9. The tubular handling system of claim 7, wherein the spreader members are adjustably, securable vertically along the support posts.

10. The tubular handling system of claim 7, wherein the base members further comprise fluid containers.

11. The tubular handling system of claim 7, wherein during tubular moving operations, the tubulars are substantially parallel to the catwalk and wherein each paired configuration of support posts is sufficiently spaced apart to allow tubulars to be moved between said paired support posts.

12. A tiering assembly for use with a plurality of tubulars arranged in at least one tier, the tiering assembly comprising:

a tubular receiving assembly having a trough suitable for receiving a tubular from one of said plurality of tubulars therein;

at least one bridging member, maintained substantially horizontal and pivotally coupled to the tubular receiving assembly so as to pivot horizontally about a point in the horizontal plane, between a retracted position and an extended position, and capable of selectably bridging the gap between the tiering assembly and the at least one tier of tubulars when in the extended position;

at least one kicker capable of ejecting a tubular from the trough; and tiering assembly height adjustment means to raise and lower the trough of the tubular receiving assembly to substantially align with the top of said at least one tier.

13. The tiering assembly of claim 12, wherein the tiering assembly height adjustment means is a scissor lift.

14. A tiering assembly for use with a plurality of tubulars arranged in at least one tier, and for use with a catwalk having a first trough with a first longitudinal axis and suitable for receiving a tubular from said plurality of tubulars therein, the tiering assembly comprising:

a tubular receiving assembly having a second trough with a second longitudinal axis and suitable for receiving a tubular from said plurality of tubulars therein;

at least one bridging member, maintained substantially horizontal and pivotally coupled to the tubular receiving assembly so as to pivot horizontally about a point in the horizontal plane, between a retracted position and an extended position, and capable of selectably bridging the gap between the tiering assembly and the at least one tier of tubulars when in the extended position;

at least one kicker capable of ejecting a tubular from the second trough; and tiering assembly height adjustment means to raise and lower the second trough of the tubular receiving assembly between a first position to substantially align with the top of said at least one tier and a second position to substantially align with the catwalk.

15. The tiering assembly of claim 14, wherein the longitudinal axis of the second trough is kept substantially horizontal when the tiering assembly height adjustment means moves the second trough between the first and second positions.

16. The tiering assembly of claim 14, wherein the longitudinal axis of the second trough is kept substantially parallel with the longitudinal axis of the first trough when the tiering assembly height adjustment means moves the second trough between the first and second positions.

* * * * *